US006588966B2

(12) United States Patent
Kane et al.

(10) Patent No.: US 6,588,966 B2
(45) Date of Patent: Jul. 8, 2003

(54) END OF TRAIN COUPLER MOUNTING DEVICE

(75) Inventors: Mark E. Kane, Orange Park, FL (US); James F. Shockley, Orange Park, FL (US); James F. Brady, Orange Park, FL (US)

(73) Assignee: Quantum Engineering, Inc., Orange Park, FL (US)

( * ) Notice: Subject to any disclaimer, the term of this patent is extended or adjusted under 35 U.S.C. 154(b) by 0 days.

(21) Appl. No.: 10/185,615

(22) Filed: Jun. 28, 2002

(65) Prior Publication Data

US 2002/0162928 A1 Nov. 7, 2002

Related U.S. Application Data

(63) Continuation-in-part of application No. 09/663,116, filed on Sep. 15, 2000, now abandoned.

(51) Int. Cl.[7] ..... F16C 11/00
(52) U.S. Cl. ..... 403/61; 248/231.51; 213/75 R
(58) Field of Search ..... 248/231.51, 229.13, 248/229.23, 316.5; 73/129; 213/61, 75 R, 127, 115, 125; 403/61

(56) References Cited

U.S. PATENT DOCUMENTS 4,093,079 A * 6/1978 Cope ..... 213/62 A
4,344,541 A * 8/1982 Chierici ..... 213/61
4,420,088 A * 12/1983 Metzger ..... 213/50.5
4,520,662 A * 6/1985 Schmid ..... 73/129
4,592,217 A * 6/1986 Fernandez et al. ..... 73/129
4,665,858 A * 5/1987 Harrigal et al. ..... 116/30
4,691,563 A * 9/1987 Martin ..... 73/129
4,876,885 A * 10/1989 Martin et al. ..... 73/129
5,131,269 A * 7/1992 Blosnick et al. ..... 73/129
5,132,269 A * 7/1992 Sasaki et al. ..... 502/205
5,176,350 A * 1/1993 McQuistian ..... 248/231.51
5,235,849 A * 8/1993 Egerton ..... 73/129
6,135,665 A * 10/2000 Alfieri et al. ..... 403/61
6,360,906 B1 * 3/2002 Kaufhold et al. ..... 213/75 R

* cited by examiner

*Primary Examiner*—Ramon O. Ramirez
(74) *Attorney, Agent, or Firm*—Arthur G. Yeager

(57) ABSTRACT

A mount base has two movable arms with jaws mounted thereon for engaging the coupler head surface adjacent and interior of the relief or core holes formed in the head. The arms are operated upwardly and downwardly via a pair of scissor links that are opened and closed by way of a threaded rod mounted between the mount base and a link carrier that moves forwardly to open the jaws for engaging the holes and rearwardly to close the jaws for disengaging from the coupler head. The device is designed to engage either of two pairs of the vertically disposed spaced holes. The mount base is adapted to carry signaling and monitoring equipment that is required on the last car of a railroad train.

31 Claims, 5 Drawing Sheets

END OF TRAIN COUPLER MOUNTING DEVICE

CROSS-REFERENCE TO RELATED APPLICATION

The present application is a continuation-in-part of an application entitled "END OF TRAIN COUPLER MOUNTING DEVICE" Ser. No. 09/663,116, filed Sep. 15, 2000, now abandoned.

STATEMENT REGARDING FEDERALLY SPONSORED RESEARCH AND DEVELOPMENT

Not Applicable.

REFERENCE TO A MICROFICHE APPENDIX

Not Applicable.

BACKGROUND OF THE INVENTION

1. Field of the Invention

The present invention pertains to apparatus for mounting marking lights and telemetry equipment to railroad cars, and particularly to an improved device for securing mountable equipment to the guard arm side of a coupler head.

2. Related Art

A wide variety of devices exist for the purpose of securing lights and other equipment to standard coupler heads, several of which are in use.

Generally, coupler heads are formed in a manner to have four relief holes arranged as two vertically spaced pairs of holes that are the terminus of two vertically spaced horizontal passageways in the guard arm side. Devices known to the prior art employ apparatus (1) that fits into and/or through the entire upper and/or lower passageway from front to rear; and (2) those that engage the pair of upper spaced or lower spaced holes. What is desired is a simple, rugged device that engages the front or rear vehicle pair of holes and does not require the additional apparatus to fit through the passageways.

Since legislation allowing for the removal of cabooses on trains, there have been several types of mounting arrangements for devices used at the end of a train to replace the lights and other warning devices of the removed cabooses.

One such arrangement is the application of a warning light and telemetry package that utilizes the flag hole in the rear coupler knuckle. While utilitarian, this arrangement is hard to apply because of how high you need to lift the equipment to install the mount into this position.

Other mounts use the coring holes in the coupler guard arm. However, each of the patented devices is an inferior device because the force exerted on the clamping arrangement is insufficient to keep the equipment tight and aligned in the proper direction.

Previous mounting arrangements utilize the coring hole pattern in a horizontal manner wherein the mount is placed in a left to right (horizontal) plane, rather than a vertical plane. Some of these arrangements become cumbersome due to the length of the mounting arrangement needed to traverse the coring holes in a horizontal plane. Since the distance between the lateral coring holes is larger than the relative distance between the vertical coring holes, use of the vertical coring holes allows for a more compact and useful mounting arrangement. Additionally, with the use of two movable arms in the vertical position, this allows for the equipment applied to this mount arrangement to always be parallel with the coring holes, allowing for the applied equipment to always be in line with the coupler and therefore to meet the intent of the FRA law on mounting warning light equipment to the rear of the train.

With the present embodiment, both a thread and scissors action is used to tighten the mount to the vertical coring holes, giving much more force and therefore a more secure fit than with other methods presently being employed.

BRIEF SUMMARY OF THE INVENTION

In one aspect of the present invention there is provided a coupler mounting device for securing signaling and monitoring equipment to a coupler head of a railroad car comprising a base and a pair of engaging means carried by the base for engaging interior and exterior surfaces of each of a respective pair of vertically spaced relief holes formed in a coupler head, and operating means connected to at least one of the engaging means for selectively moving at least one engaging means in a direction directly opposite to another said engaging means to removably secure the base to a coupler head. The engaging means includes a pair of first arm means, each first arm means having a front portion for engaging a coupler head and a rear portion, means for mounting the rear portion to the base. The operating means further includes a pair of second arms having a front portion and a rear portion, first means for mounting the front portion of one second arm to the front portion of one first arm means, carrier means, and second means for mounting the rear portion of each second arm to the carrier means. The operating means further includes a rod having a non-threaded portion mounted to the base and a threaded portion mounted to the carrier means. The rod is rotatable in one direction to move the carrier means forwardly away from the mount base in a manner to cause the front portions of the second arms to move away from each other for moving one first arm means upwardly and the other first arm means downwardly to engage the front portions of the first arm means to a coupler head and is rotatable in another direction to move the carrier means rearwardly to cause the front portions of the second arms to move closer to each other for moving the one first arm means downwardly and the another first arm means upwardly to disengage the first arm means from a coupler head.

The device includes a pair of jaw members and means for mounting each jaw member to the front-end portion of each first arm means. The mounting means for mounting respective jaw member to the front portion includes means for rotatably mounting the respective the jaw member. The means for rotatably mounting includes rotation-limiting means for restricting the degree of rotation of respective jaw member.

In another aspect of the invention the operating means is selectively operable for moving the other engaging means away from the at least one engaging means. The pair of engaging means are disposed generally vertically and engage is respective oppositely disposed upper and lower portions of a pair of vertically spaced relief holes formed in a coupler. The pair of engaging means engage interior and exterior surfaces defining a pair of relief holes formed in a coupler head.

In a further aspect of the present invention there is provided a coupler mounting device for securing signaling and monitoring equipment to a coupler head of a railroad car comprising a mount base, engaging means carried by the mount base for engaging interior surfaces of each of a respective pair of vertically spaced relief holes formed in a coupler head, operating means connected to the engaging means for selectively moving the engaging means into and out of engagement with a coupler head, the engaging means into and out of engagement with a coupler head, the engaging means including a pair of movable arms with each arm having a front portion and a rear portion. Also included is means for mounting each rear portion to the mount base, the front portions of the arms being locatable adjacent to respective relief holes in a coupler head. The engaging means has a pair of jaw members, each jaw member being mounted to the front portion of respective arm and engageable with respective relief holes in a coupler head, the operating means further includes a pair of scissor links having a forward portion and a back portion and means for mounting the forward portion of each scissor link to respective front portions of the arms and movable means for mounting each back portion of the links. The operating means further includes a rod having a non-threaded portion rotatably mounted to the mount base and a threaded portion threadedly engaged with the movable means, the rod being rotatable in one direction to move the movable means forwardly away from the mount base to cause the forward portions of the scissor links to move away from each other, the arms being moved with one arm moving upwardly. There is also means for mounting each jaw member to front end portion of each arm, the rod being rotatable in another direction opposite to one direction to move the movable means rearwardly to cause the forward portions of the scissor links to move closer to each other and for moving the one arm downwardly and the other arm upwardly to disengage the jaw members from a coupler head. The mounting means for the jaw members includes means for rotatably mounting the respective jaw members to permit self-alignment of the jaw members to surfaces of a pair of relief holes, which includes means for limiting the degree of rotation of the respective jaw members. The base is adapted for the attachment of signaling and monitoring apparatus thereto. Each jaw member includes a pair of upstanding walls defining a channel therebetween.

In another aspect of the invention there is provided a coupler mounting device for securing signaling and monitoring equipment to the coupler head of a railroad car comprising a mount base and engaging means carried by the mount base for engaging interior and exterior surfaces of shoulders defining a respective pair of vertically spaced relief holes formed in a coupler head, and exterior operating means connected to the engaging means for selectively moving the engaging means into and out of engagement with a coupler head, the engaging means having at least one movable arm means, each arm having a front portion and a rear portion, means for mounting each rear portion to the mount base, the front portion being locatable to adjacent respective relief holes in a coupler head, the engaging means further having a pair of jaw members, one jaw member being mounted to the front portion of at least one movable arm means and engageable with inner and outer surfaces of a shoulder of a relief hole in a coupler head, the engaging means having another arm means with another jaw member being mounted thereto. There is also means for rotatably mounting respective jaw members to permit self-alignment of the jaw members to surfaces of shoulders of a pair of relief holes and means for limiting the degree of rotation of respective jaw members. In addition, each jaw member includes a pair of generally upstanding walls defining a sloping channel therebetween.

Additional aspects of the invention include engaging means including a pair of arm members each having a front portion for engaging a coupler head and a rear portion and first means for mounting one arm member to the base in a fixed position and second means for movably mounting another arm member to the base. Also included is a pair of jaw members, means for mounting each jaw member to the front-end portion of respective arm member. The operating means includes rotary means for selectively moving at least one engaging means vertically upwardly and downwardly. The second means includes rotary means for moving another arm member vertically upwardly and downwardly. The second means also includes a carrier attached to at least one engaging means, the rotary means being defined by an elongated screw having threads therealong, the carrier being threadably mounted to the screw. There is also included a guide means mounted between the base and the carrier for guiding the carrier in a substantially vertical path. The guide means includes at least one vertically disposed channel, the carrier including at least one post member located in at least one channel, the at least one channel and the at least one post member cooperatively guiding the carrier vertically.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE INVENTION

Figure 2:
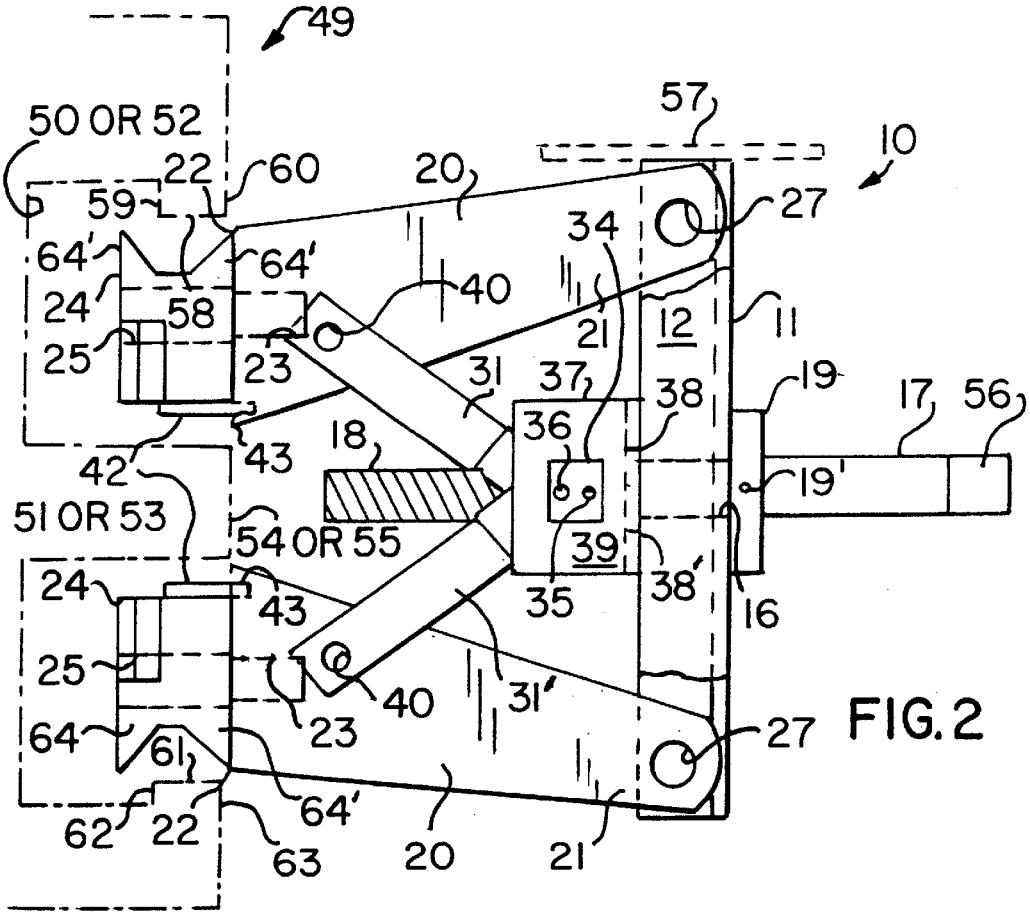
FIG. 2 is a side elevational view of the coupler-mounting device in accord with the present invention.
Figure 3:
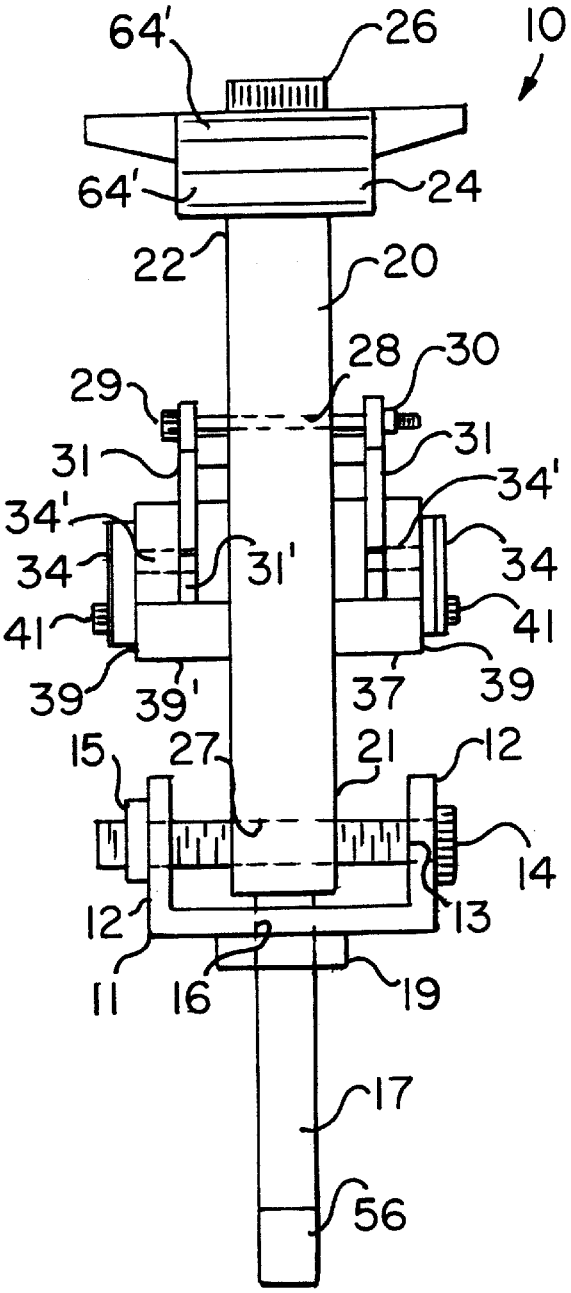
FIG. 3 is a top view of the device of FIG. 2.

With respect to FIGS. 2 and 3, the coupler-mounting device in accord with the present invention is shown generally at numeral 10. The mount base or housing 11 is a steel channel member having sidewalls 12 having a respective bolthole 13 therethrough for mounting a bolt 14, which is secured in place by nut 15. The rear wall of mount base 11 has a bolthole 16 for carrying rod 17 which is secured via a collar 19 carrying pin 19'. Rod 17 has a threaded end portion 18.

Upper and lower arm members 20 are substantially identical and include a rear portion 21 and a forward portion 22. Threaded holes 23 are aligned with holes 25 through jaws 24 that are rotatably secured to arms via bolts 26. Rear portions 21 have bolt holes 27 therethrough aligned with holes 13 for mounting to mount base 11 with bolt 14.

Rod 17 employs left-handed threads 18 to control forward and rearward movement of scissors mounting frame 37.

Respective upper 31 and lower 31' scissor links have bolt-holes 40 for mounting to the forward portion 22 of arms 20 with bolt 29 and nut 30 through bolthole 28 in the arm 20.

Figure 4:
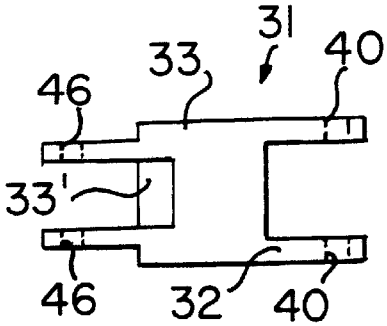
FIG. 4 is a plan view of one of the scissors links of FIG. 2.
Figure 5:
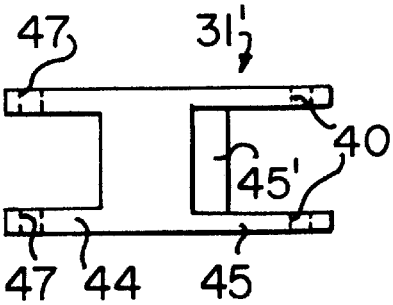
FIG. 5 is a plan view of the other scissors link of FIG. 2.

With respect to FIGS. 4 and 5, upper link 31 has a forward U-shaped portion 32 and a rearward or back U-shaped portion 33. Portion 33 has pin holes 46. In a similar manner, lower link 31' has a forward U-shaped portion 45 and a rearward or back U-shaped portion 44 having pin holes 47. Slanted portions 33' and 45' provide for enough clearance from rod 17 to allow for movement of the scissors 31, 31' to the maximum extent needed for operation of the device 10.

With respect again to FIGS. 2 and 3, scissors mounting frame 37 is a metal channel member having rear wall 39' into which is mounted a threaded member 38' in hole 38 for carrying threads 18 of rod 17. Side walls 39 are used to mount scissor pin carriers 34 with bolts 41 through holes 35. Carriers 34 each include a permanently mounted pin 34' in hole 36 that fits through respective link holes 46 and 47 and provides for scissor action pivot movement of respective links 31, 31'.

Figure 1:
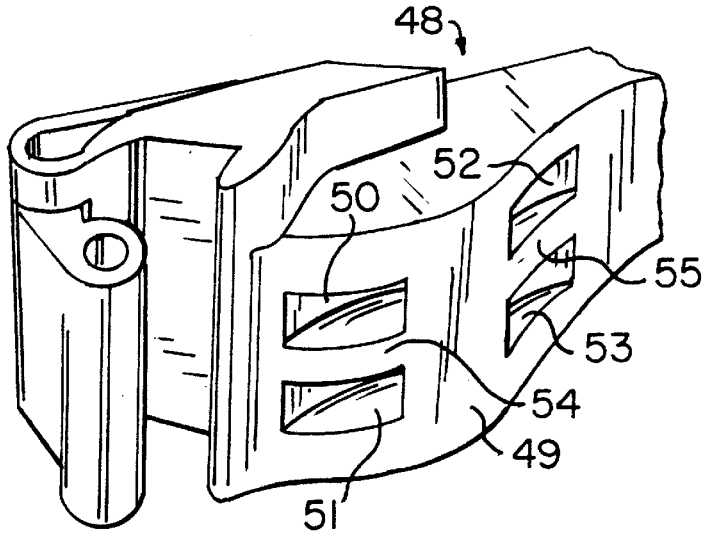
FIG. 1 (PRIOR ART)
FIG. 1 is a perspective view of a prior art coupler head of the type widely used in the railroad industry.

As rod 17 is rotated via appropriate means attached to rod end 56, carrier 37 is moved rearwardly as in FIG. 2 to contract the vertical spacing of jaws 24 or to forwardly extend carrier 37 as shown in FIG. 3 to spread jaws 24. As shown in FIGS. 1 and 2, when the jaws 24 are inserted into a respective pair of relief holes 50 and 51 or 52 and 53 they are then expanded by turning rod 17 to force jaws 24 against coupler 48 across web 54 or 55.

Preferably end portion 22, of an arm 20 has a pin hole 43 into which is mounted a pin 42 which rests against jaw 24. This limits the rotation of the respective jaw 24 to allow them to be easily installed in respective relief hole 50–53. Some rotation is desired to provide for self-aligning of the jaws 24 due to irregularities in the holes and their respective interior surfaces. Jaw 24 is formed of two upstanding walls 64' defining a channel therebetween which slopes from its base outwardly to the free ends of the wall 64'. Upper jaw 24 will engage the interior surface 59 and exterior surface 60 of an upper shoulder 58. The lower jaw 24 engages a lower shoulder 61 at interior surface 62 and exterior surface 63 (FIG. 2).

Mount base 11 is adapted for the securing of signaling and monitoring apparatus thereto by welding a plate 57 to the upper surface of mount base 11 (FIG. 2), and such apparatus is supported by plate 57.

Figure 7:
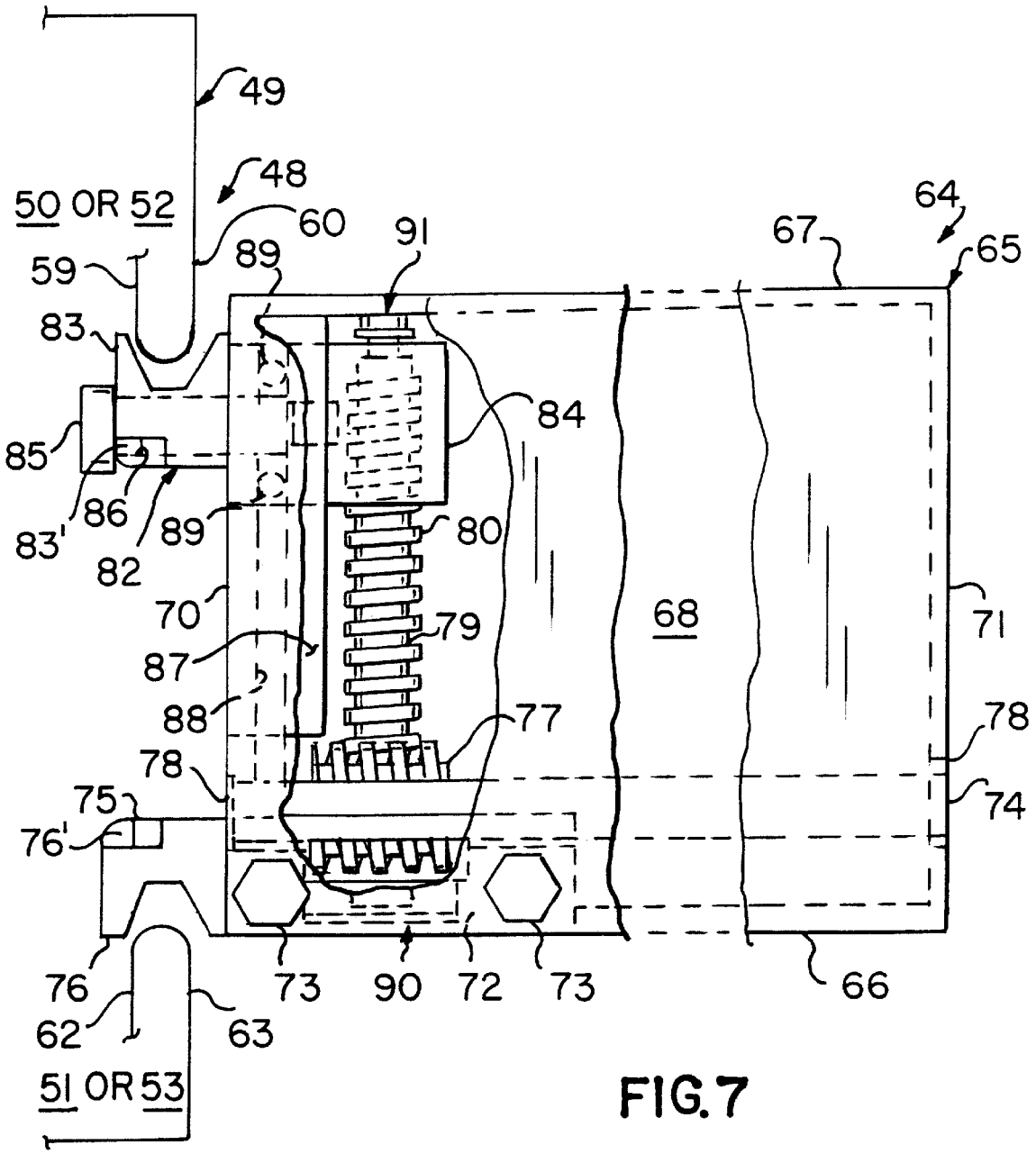
FIG. 7 is a partially cut away view of another embodiment of a coupler mounting device in accord with the present invention.
Figure 8:
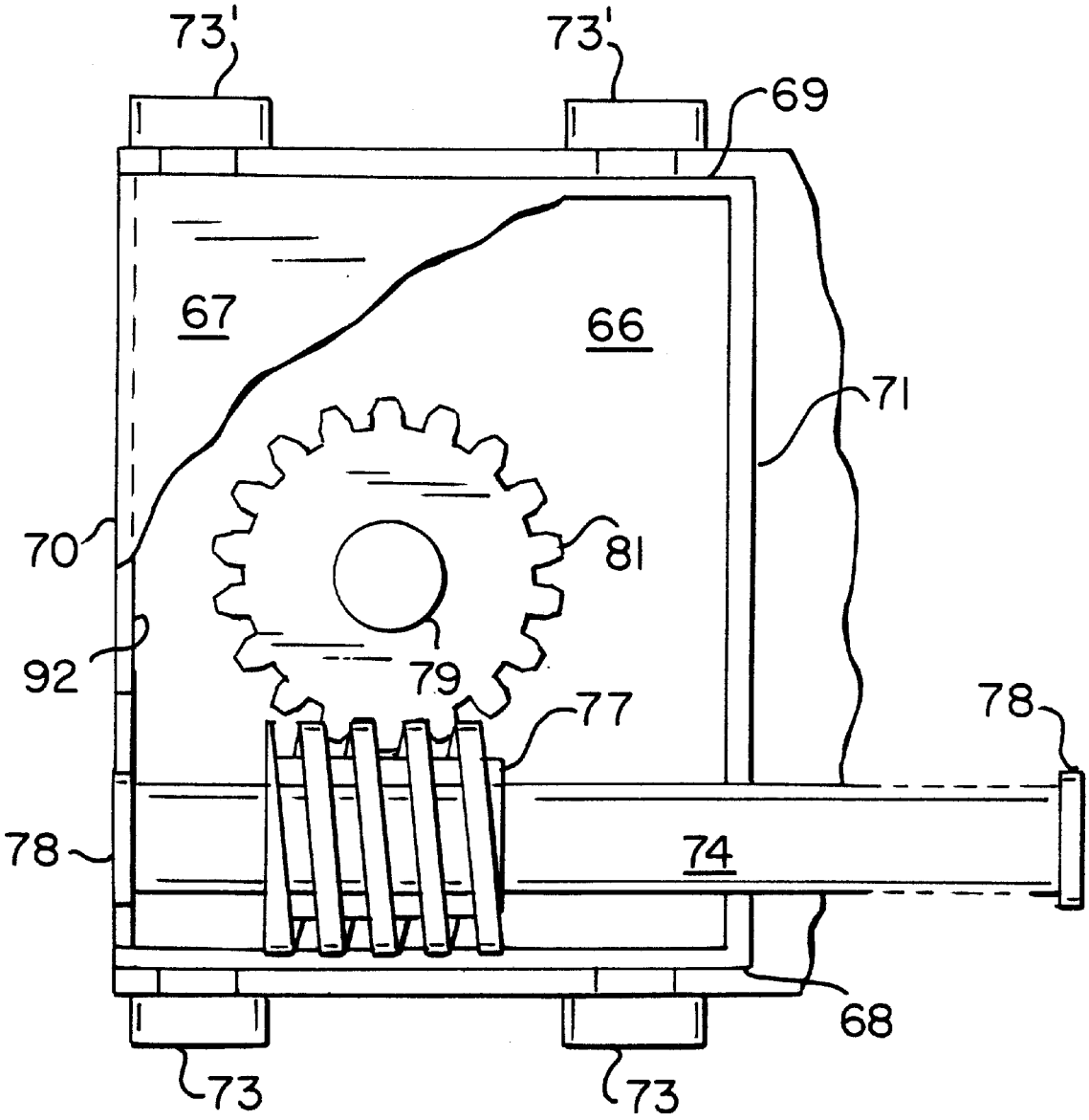
FIG. 8 is a partially cut away perspective view of the device of FIG. 7.

With respect to FIGS. 7 and 8, an alternate embodiment of the coupler device is shown at numeral 64. Mount base or housing 65 includes bottom wall 66, top wall 67, side walls 68 and 69, front wall 70 and rear wall 71. A base member 72 provides a mounting for carrying operating rod 74 and is secured to housing 65 via bolts 73. Fixed engaging arm 75, which includes jaw 76, is also secured via the bolts 73.

Operating rod 74 includes a row of threads 77 and is supported at its ends by bearings 78. The rotation of rod 74 causes rotation of gear ring 81 (FIG. 8) that carries arm operating screw 79 which has threads 80.

Movable apparatus 82 has a jaw 83 mounted on the end thereof via bolt 85 through hole 86. Jaw 83 is carried by bracket 84 via bolt 85 that is threaded onto screw 79. Guide means includes a channel member 87 having channel 88 into which guide means in the form of posts 89 ride to guide bracket 84 vertically due to rotation of screw 79 via operating rod 74. The apparatus 82 extends through vertical channel 92 (FIG. 8) formed in front wall 70. Screw 79 is mounted via bearings 91 and 92 in a conventional manner.

Jaws 76 and 83 are mounted to have limited rotation with regard to respective arms 75 and 82 to provide for self-aligning to allow for irregularities in the relief holes 50–53 in coupler head 48 when the arm 82 is moved to engage the head 48.

Figure 6:
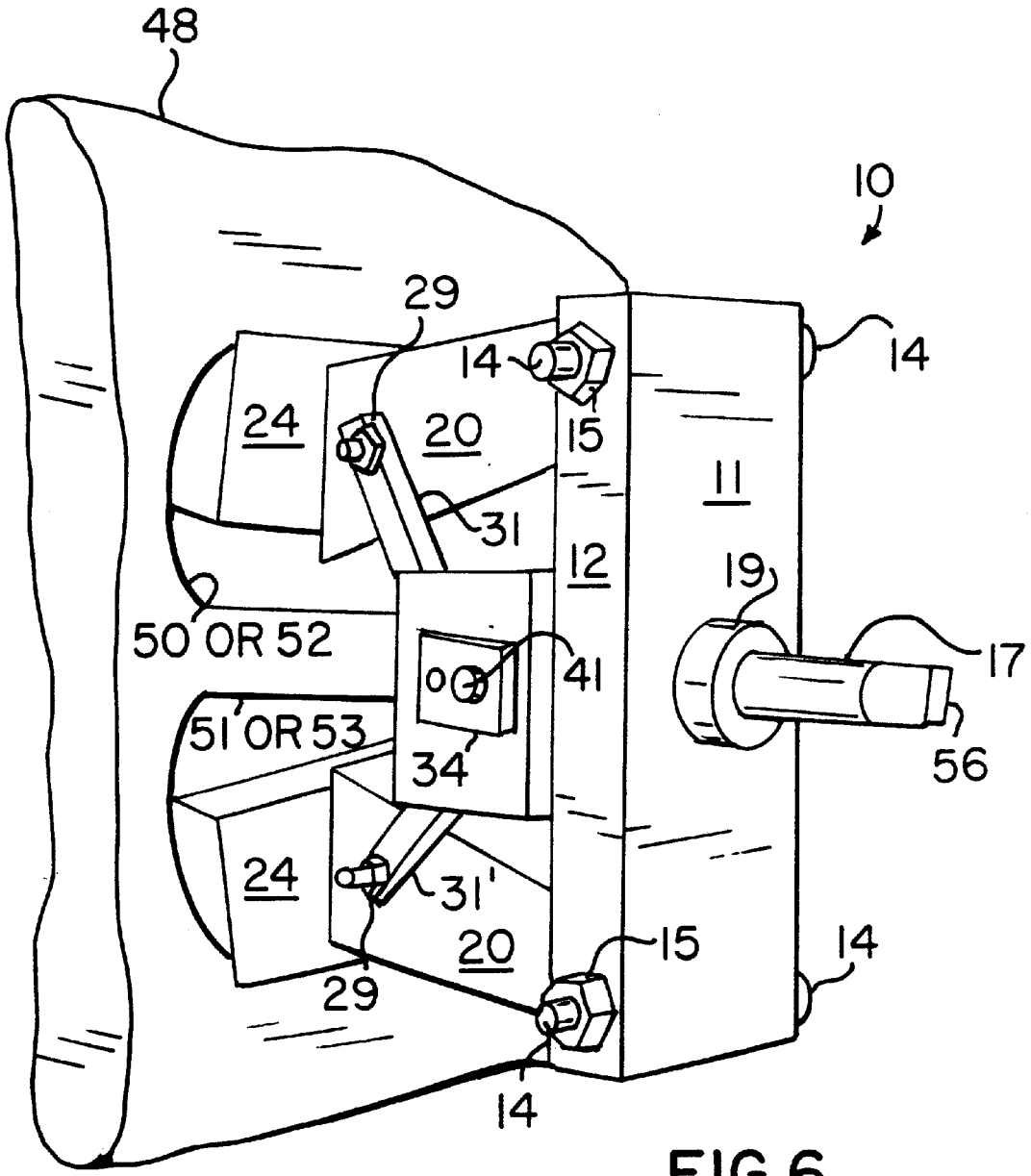
FIG. 6 is a perspective view of the device of FIG. 1 in use attached to a coupler head.

Jaws 76 and 83 are substantially identical to jaws 24 with upstanding walls having a channel therebetween, which slope from its base. The upper and lower jaws 83 and 76 engage the interior surfaces 59 and 62 and exterior surfaces 60 and 63 in a manner as also shown in FIGS. 2 and 6. A respective pair of spaced oppositely disposed wing members 76' and 83' limit movement of a jaw 76 or 83 by engaging the vertical sides of a respective relief hole 50–53.

Housing 65 is adapted for the securing of signaling and monitoring apparatus thereto by mounting such apparatus in any appropriate manner.

Operating rod 74 may include a handle connected thereto in either a permanent or temporary manner.

While the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

What is claimed as new and what it is desired to secure by Letters Patent of the United States is:

1. A coupler mounting device for securing signaling and monitoring equipment to a coupler head of a railroad car comprising a base and a pair of engaging means carried by said base for engaging interior and exterior surfaces of each of a respective pair of vertically spaced relief holes formed in a coupler head, and operating means connected to at least one of said engaging means for selectively moving said at least one engaging means vertically away from another said engaging means to engage a coupler head and secure said base to a coupler head and vertically toward said another engaging means to disengage a coupler head and remove said base from a coupler head.

2. The device as defined in claim 1 wherein said engaging means includes a pair of first arm means, each said first arm means having a front portion for engaging a coupler head and a rear portion, means for mounting said rear portion to said base.

3. The device as defined in claim 2 wherein each said front portion includes a jaw member, means for mounting each said jaw member to said first arm means.

4. The device as defined in claim 3 wherein said means for mounting respective said jaw member includes means for pivotally mounting respective said jaw member.

5. The device as defined in claim 4 wherein said means for pivotably mounting includes limiting means for restricting pivoting of respective said jaw member.

6. The device as defined in claim 3 wherein each said jaw member includes a pair of upstanding walls defining a channel therebetween.

7. The device as defined in claim 2 wherein said operating means further includes a pair of second arms having a front portion and a rear portion, first means for mounting said front portion of one said second arm to said front portion of one said first arm means, carrier means, and second means for mounting said rear portion of each said second arm to said carrier means.

8. The device of claim 7 wherein said operating means further includes a rod having a non-threaded portion mounted to said base and a threaded portion mounted to said carrier means, said rod being rotatable in one direction to move said carrier means forwardly away from said mount base in a manner to cause said front portions of said second arms to move away from each other for moving one said first arm means upwardly and the other said first arm means downwardly to engage said front portions of said first arm means to a coupler head and being rotatable in another direction to move said carrier means rearwardly to cause said front portions of said second arms to move closer to each other for moving said one first arm means downwardly and said another first arm means upwardly to disengage said first arm means from a coupler head.

9. The device of claim 1 wherein said operating means is selectively operable for moving said another engaging means away from said at least one engaging means.

10. The device of claim 1 wherein said pair of engaging means are disposed generally vertically and engage in respective oppositely disposed upper and lower portions of a pair of vertically spaced relief holes formed in a coupler.

11. The device of claim 1 wherein said pair of engaging means engage interior and exterior surfaces defining a pair of relief holes formed in a coupler head.

12. The device of claim 11 wherein said pair of engaging means are disposed generally vertically and engage in respective oppositely disposed upper and lower portions of a pair of vertically spaced relief holes formed in a coupler.

13. The device as defined in claim 1 wherein said engaging means includes a pair of arm members each having a front portion for engaging a coupler head and a rear portion, first means for mounting one said arm member to said base in a fixed position and second means for movably mounting another said arm member to said base.

14. The device as defined in claim 13 further including a pair of jaw members, means for mounting each said jaw member to said front end portion of respective said arm member.

15. The device as defined in claim 13 wherein said operating means includes rotary means for selectively moving said at least one engaging means vertically upwardly and downwardly.

16. The device as defined in claim 13 wherein said second means includes rotary means for moving said another arm member vertically upwardly and downwardly.

17. The device as defined in claim 16 wherein said second means includes a carrier attached to said at least one engaging means, said rotary means being defined by an elongated screw having threads therealong, said carrier being threadably mounted to said screw.

18. The device as defined in claim 17 further including guide means mounted between said base and said carrier for guiding said carrier in a substantially vertical path.

19. The device as defined in claim 17 wherein said guide means includes at least one vertically disposed channel, said carrier including at least one post member located in said at least one channel, said at least one channel and said at least one post member cooperatively guiding said carrier vertically.

20. The device as defined in claim 1 wherein said pair of engaging means further includes a respective jaw member engageable with spaced relief holes of a coupler head.

21. A coupler mounting device for securing signaling and monitoring equipment to a coupler head of a railroad car comprising a mount base, engaging means carried by said mount base for engaging interior surfaces of each of a respective pair of vertically spaced relief holes formed in a coupler head, operating means connected to said engaging means for selectively moving said engaging means including a pair of movable arms with each said arm having a front portion and a rear portion, means for mounting each said rear portion to said mount base, said front portions of said arms being locatable adjacent respective said relief holes in a coupler head, said engaging means having a pair of jaw members, each said jaw member being mounted to said front portion of respective said arm and movable away from another said jaw member to engage respective relief holes in a coupler head and secure said mount base to a coupler head and toward said another jaw member to disengage a coupler head and remove said mount base from a coupler head.

22. The device of claim 21 wherein said operating means further includes a pair of scissor links having a forward portion and a back portion and means for mounting said forward portion of each said scissor link to respective said front portions of said arms, and movable means for mounting each back portion of said links.

23. The device of claim 22 wherein said operating means further includes a rod having a non-threaded portion rotatably mounted to said mount base and a threaded portion threadedly engaged with said movable means, said rod being rotatable in one direction to move said movable means forwardly away from said mount base to cause said forward portions of said scissor links to move away from each other, said arms being moved with one said arm moving upwardly.

24. The device as defined in claim 22 further including means for mounting each said jaw member to said front end portion of each said arm, said rod being rotatable in another direction opposite to said one direction to move said movable means rearwardly to cause said forward portions of said scissor links to move closer to each other and for moving said one arm downwardly and said another arm upwardly to disengage said jaw members form a coupler head.

25. The device as defined in claim 24 wherein said mounting means for said jaw members includes means for rotatably mounting respective said jaw members to permit self-alignment of said jaw members to surfaces of a pair of relief holes.

26. The device as defined in claim 25 further including means for limiting the degree of rotation of respective said jaw members.

27. A coupler mounting device for securing signaling and monitoring equipment to the coupler head of a railroad car comprising a mount base and engaging means carried by said mount base for engaging interior and exterior surfaces of shoulders defining a respective pair of vertically spaced relief holes formed in a coupler head, and operating means connected to said engaging means for selectively moving said engaging means, said engaging means having at least one moveable arm means, each said arm means having a front portion and a rear portion, said front portion being locatable adjacent respective relief holes in a coupler head, said engaging means further having a pair of jaw members, one said jaw member being mounted to said front portion of at least one movable said arm means and engageable with inner and outer surfaces of a shoulder of a relief hole in a coupler head, said engaging means having another arm means with another said jaw member being mounted thereto said one jaw member mounted to said one movable arm means being movable vertically away from another said jaw member to engage respective relief holes in a coupler head and secure said mount base to a coupler head and toward said another jaw member to disengage a coupler head and remove said mount base from a coupler head.

28. The device as defined in claim 27 further including means for rotatably mounting respective said jaw members to permit self-alignment of said jaw members to surfaces of shoulders of a pair of relief holes.

29. The device as defined in claim 28 further including means for limiting the degree of rotation of respective said jaw members.

30. The device as defined in claim 27 wherein each said jaw member includes a pair of generally upstanding walls defining a sloping channel therebetween.

31. The device as defined in claim 30 wherein each said jaw member includes a pair of spaced laterally extending wing members for engaging vertical sides of a respective relief hole to limit movement of a said jaw member mounted therein.

* * * * *